United States Patent [19]

Ouarve et al.

[11] Patent Number: 4,883,199

[45] Date of Patent: Nov. 28, 1989

[54] FLUID DISPENSING DEVICE

[75] Inventors: Vernon K. Ouarve, Minneapolis; Dennis L. McCormick, Mendota Heights, both of Minn.

[73] Assignee: Graco Inc., Minneapolis, Minn.

[21] Appl. No.: 300,484

[22] Filed: Jan. 23, 1989

Related U.S. Application Data

[63] Continuation of Ser. No. 78,917, Jul. 28, 1987, abandoned.

[51] Int. Cl.[4] ..... B67D 5/30

[52] U.S. Cl. ..... 222/14; 222/20

[58] Field of Search ..... 222/14, 16, 20, 52, 222/59, 33, 71, 73, 333, 504

[56] References Cited

U.S. PATENT DOCUMENTS

| | | | |
|---|---|---|---|
| 2,683,224 | 7/1954 | Cole, Jr. | 290/52 |
| 2,804,991 | 9/1957 | Burleyson | 222/20 |
| 2,925,936 | 2/1960 | Whitefield et al. | 222/20 |
| 2,988,916 | 6/1961 | Waugh | 73/231 |
| 3,185,344 | 5/1965 | Kenney | 222/20 |
| 3,343,720 | 9/1967 | Barry | 222/20 |
| 3,523,627 | 8/1970 | Crozier | 222/20 |
| 3,641,536 | 2/1972 | Prosprich | 340/203 |
| 3,713,558 | 1/1973 | Pech | 222/20 |
| 3,937,362 | 2/1976 | Salmijak et al. | 222/20 |
| 3,989,066 | 11/1976 | Sturman et al. | 137/624.2 |
| 4,004,612 | 1/1977 | Hummel, Jr. et al. | 137/624.11 |
| 4,005,802 | 2/1977 | Fox | 222/14 |
| 4,051,998 | 10/1977 | Zabel | 364/465 |
| 4,057,173 | 11/1977 | Tal | 222/20 |
| 4,101,874 | 7/1978 | Denison et al. | 340/606 |
| 4,140,013 | 2/1979 | Hunger | 73/229 |
| 4,150,767 | 4/1979 | Pitches et al. | 222/23 |
| 4,253,341 | 3/1981 | Ikeda et al. | 73/861.77 |
| 4,275,291 | 6/1981 | Feller | 235/92 FL |
| 4,306,457 | 12/1981 | Fukui et al. | 73/861.77 |
| 4,389,902 | 6/1983 | Kataoka et al. | 73/861.77 |
| 4,392,514 | 7/1983 | Farley et al. | 137/624.2 |
| 4,401,141 | 8/1983 | Rosen et al. | 141/192 |
| 4,475,666 | 10/1984 | Bilbrey et al. | 222/14 |
| 4,498,843 | 2/1985 | Schneider et al. | 417/22 |
| 4,526,188 | 7/1985 | Olsson et al. | 137/3 |
| 4,541,563 | 9/1985 | Uetsuhara | 239/64 |
| 4,550,859 | 11/1985 | Dow, Jr. et al. | 222/14 X |
| 4,553,433 | 11/1985 | Hicks | 73/273 |
| 4,571,995 | 2/1986 | Timme | 73/199 |
| 4,572,255 | 2/1986 | Rabinovich | 222/59 X |

FOREIGN PATENT DOCUMENTS

| | | | |
|---|---|---|---|
| 44623 | 3/1984 | Japan | 222/14 |

OTHER PUBLICATIONS

"Design Specification for Fluid Meter Control Circuit," Rev. A., 4/20/87, By Doradus Corporation, 6095 E. River Road, Fridley, Minn. 55432.

"Design Specification For A Semi-Custom Gate Array Circuit," Rev. C. 4/20/87, Doradus Corporation, c/o Bob Kimber.

*Primary Examiner*—Michael S. Huppert

*Attorney, Agent, or Firm*—Douglas B. Farrow

[57] ABSTRACT

The device is provided for measuring an exact amount of fluid in a dispensing operation, the device being made easily portable and self-contained. The fluid motor has a device on it to measure the number of rotations of the motor and that number of rotations is translated through appropriate circuitry into a corresponding fluid volume. Initiation of the dispense cycle by means of manually opening a handle latches open a valve which stays open until the desired predetermined volume of fluid has been dispensed. At that point, a solenoid is energized with a brief electrical pulse which unlatches the valve and allows it to close quickly, thereby assuring that an extremely accurate amount of fluid has been dispensed.

12 Claims, 3 Drawing Sheets

FLUID DISPENSING DEVICE

This is a continuation of application Ser. No. 078,917, filed July 28, 1987 now abandoned.

BACKGROUND OF THE INVENTION

Various types of fluid dispensing devices are, of course, well known. Pumps at gas stations dispense fluid and measure the amount dispensed and are capable of halting upon reaching a predetermined amount to be dispensed. Similarly, manual dispensing apparatus have been used for many years for filling cars and other mechanical devices with oil and/or grease such that an amount is mechanically dialed into a dispensing meter and that amount is dispensed. Such devices are sometimes less desirable as they are not easily susceptible to a change in the type of units or with respect to quantities which are dispensed. Such units are also not as accurate as might otherwise be desired. These further tend to be reasonably complicated and in need of repair reasonably often due to leakage and breakage.

It is therefore an object of this invention to provide a fluid dispensing meter which is highly accurate, hand held, easy to use, reliable and inexpensively manufacturable. It is further an object of this invention to provide a fluid dispensing meter which is also capable of providing information as to the total amount of fluid dispensed by the system in addition to the amount dispensed in the particular operation, and to have the unit of measurement easily field convertible.

SUMMARY OF THE INVENTION

Fluid to be dispensed flows through a fluid motor having a multi-lobed pump and lobed rotating housing which cooperate to form a positive displacement pump capable of highly efficiently and accurately measuring the amount of fluid flowing there through. A magnet is located on the shaft of the fluid motor; that magnet is in turn sensed by a reed switch located in the housing of the fluid motor. The reed switch counts the number of rotations of the fluid motor which is directly proportional to the amount dispensed through the fluid motor. Appropriate electronics convert the number of rotations into the amount of fluid dispensed and that amount is compared with the preset amount which has been entered via a keypad on the dispensing unit and compared.

When the predetermined amount is reached, a 20–50 millisecond pulse of electricity is sent to a solenoid which, during its brief energization, releases and allows the valve to close. The valve has been previously manually actuated by the operator against a reasonably strong spring. Thus, the force necessary to positively close the valve is in effect supplied by the operator during the opening motion and is stored in the spring. The solenoid thus merely serves to release the spring and allow the valve to close of its own volition.

These and other objects and advantages of the invention will appear more fully from the following description made in conjunction with the accompanying drawings wherein like reference characters refer to the same or similar parts throughout the several views.

A BRIEF DESCRIPTION OF THE DRAWINGS

DESCRIPTION OF THE PREFERRED EMBODIMENT

Figure 4:
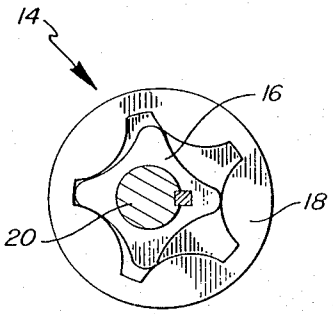
FIG. 4 is a cross-section of the fluid motor.

Fluid dispensing unit 12 of the instant invention is provided with a fluid motor housing 12 having a positive displacement fluid motor 14 located therein. Fluid motor 14 is shown in detail in FIG. 4 and has a central rotor 16 and a surrounding rotating housing 18 therewith. This type of fluid motor is in general well known in the art and will not be described more fully hereinafter. This type of motor is, however, particularly suited for accurate measurement in the instant invention. Because of the motor's construction, no rotating seals are ncessary and hence the unit is practically immune from leaks. Other types of positive displacement motors such as gear types are also capable of functioning as desired. Rotor 16 has a shaft 20 which has located on the end thereof a rotating magnet 22 which in turn triggers reed switch 24 through coil 26, located in fluid motor housing 12. Fluid enters through port 28 and exits through port 30.

Figure 1:
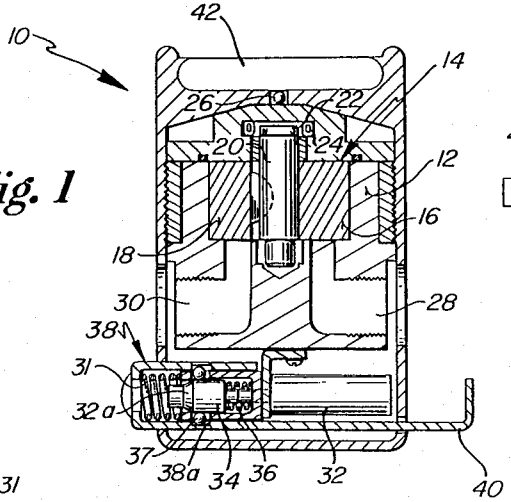
FIG. 1 is a cross-section of the fluid dispensing unit of the instant invention.

As shown in FIG. 1, the device is storing energy in spring 31 while the valve (not shown) is open. When the predetermined amount of fluid has been dispensed, solenoid 32 is actuated, thereby pulling release trigger 34 to the right against return spring 36. Doing so allows detent balls 38 to drop downwardly over the ramp **32*a* of solenoid 32. This in turn allows the actuator sleeve 38 to move to the left and thereby release the energy stored in spring 31, thereby pulling shut valve actuator 40. Prior to starting the present dispense, the operator manually pushes actuator sleeve 38, thereby compressing coil spring 31 until the detent balls 38 engage the internal groove 38*a* in the actuator sleeve 38. This allows the release trigger 34 to move forward from the light force of spring 36, thereby locking actuator sleeve 38 and pull actuator 40 in the position shown. The valve controlling fluid flow can be any suitable type of valve, one example being shown in the FIG. 2** embodiment.

Figure 3:
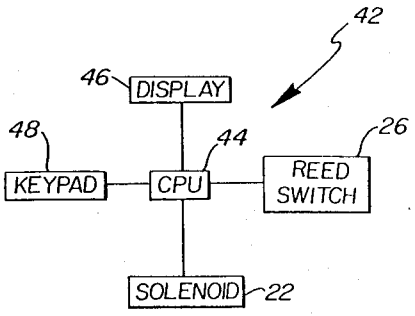
FIG. 3 is a schematic representation of the electronics of the instant invention.

FIG. 3 shows a schematic representation of the electronics of the unit of the instant invention. The electronic package, generally designated 42, is located in the top of housing 12 and is comprised generally of a central processing unit (CPU), a liquid crystal or similar display 46, a connection to reed switch 26, a connection to solenoid 32, and a keypad 48. the electronics used in this device are generally conventional and need not be described more fully hereinafter. In particular, the user enters the predetermined amount which he wishes to dispense through keypad 48. Upon the reed switch having sent an appropriate number of pulses to CPU 44, a 20–50 millisecond burst of electricity is sent to energize solenoid 22, thereby releasing the valve. Display 46 can be set to display the amount to be dispensed, the amount that has been dispensed so far, or even a cumulative amount which the device has dispensed over time since, for instance, the container from which it dispenses was filled. CPU 44 may be easily programmed to change the units of measurement as desired, e.g., from quarts to liters.

If desired, of course, it can be realized that the fluid motor 14 can be used to drive a small generator and recharge the batteries, thereby extending the life of the invention for almost an indefinite period. This can be seen in FIG. 2; a digital display is provided which can show both the amount of fluid dispensed and the preset amount which has been punched in via the keyboard.

Figure 2:
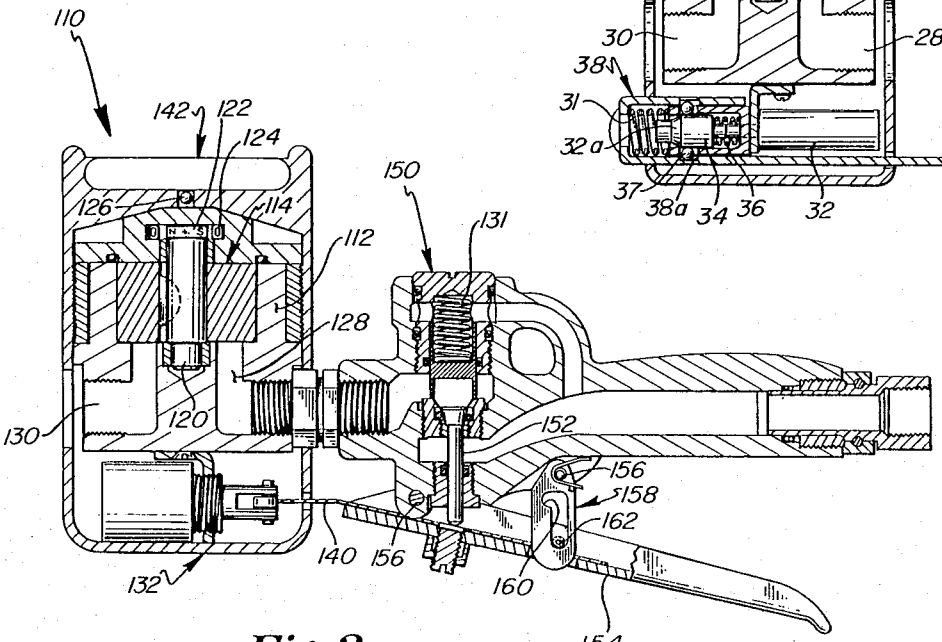
FIG. 2 is a cross-section of an alternate embodiment of the instant invention.

Turning to the alternate embodiment shown in FIG. 2, the fluid dispensing unit 110 is generally provided with a motor housing 112, which contains therein a fluid motor 114. Motor 114 is the same as the FIG. 1 embodiment motor 14 shown in cross-section in FIG. 4. Shaft 120 of fluid motor 114 has a magnet 122 at one end thereat, the rotation of which is sensed by reed switch 126. If a coil 124 is placed outside of rotating magnet 122, a small alternator has been produced, the output of which can be rectified and used to recharge the circuit batteries. An inlet port 128 flows incoming fluid to fluid motor 114 and an outlet port 130 directs the fluid to wherever appropriate.

A valve assembly 150 is provided having a fluid valve 152 therein which is biased in a closed position by a strong energy storage spring 131. Valve 152 is actuated by a hand trigger 154, which pivots on a hinge 156. Closing trigger 154 simultaneously opens fluid valve 152 starting flow and precompressing spring 131. With the trigger closed, the operator can switch the latch 158 placing slot 160 around pin 162 holding the trigger 154 closed and the fluid valve 52 open. Fluid dispense will continue until the preset volume has been reached. The electronics package 142 will send the electrical pulse to solenoid 132 pulling the actuator band 140 and releasing trigger latch 158.

It is contemplated that various changes and modifications may be made to the fluid dispensing unit without departing from the spirit and scope of the invention as defined by the following claims.

What is claimed is:

1. A fluid dispensing unit for dispensing a predetermined volume of fluid, said unit comprising:

a rotary positive displacement measuring means having an inlet and an outlet;

a valve connected to said measuring means, said valve having an open position and a closed position inlet;

actuating means for opening said valve;

means for biasing said valve in a closed position;

means for latching said valve in an open position;

means for releasing said latch means in response to the passage of said predetermined fluid volume through said measuring means said release means comprising:

a solenoid, said solenoid being unbiased; and a battery power source, said power source powering said measuring means and energizing said solenoid, said solenoid releasing said latch means upon dispensing of said predetermined volume of fluid.

2. The fluid dispensing unit of claim 1 wherein said actuating means comprises a manually actuable handle.

3. The fluid dispensing unit of claim 1 wherein said measuring means comprises a fluid turbine having a shaft.

4. The fluid dispensing unit of claim 3 wherein said measuring means counts the rotations of said fluid turbine.

5. The fluid dispensing unit of claim 4 further comprising means for displaying the amount of fluid dispensed.

6. The fluid dispensing unit of claim 5 further comprising keyboard means for entering said predetermined amount into said measuring means.

7. The fluid dispensing unit of claim 4 wherein said measuring means comprises a magnet on said shaft and a reed switch near said magnet but not in fluid contact for counting shaft rotations.

8. The fluid dispensing unit of claim 3 wherein said fluid turbine is a lobed fluid motor.

9. The fluid dispensing unit of claim 1 further comprising means for manually releasing said latch means.

10. The fluid dispensing unit of claim 3 wherein said measuring means counts the rotations of said fluid turbine.

11. The fluid dispensing unit of claim 10 wherein said measuring means comprises a magnet on said shaft and a reed switch near said magnet but not in fluid contact for counting shaft rotations.

12. The fluid dispensing unit of claim 11 wherein said fluid turbine is a lobed fluid motor.

* * * * *

UNITED STATES PATENT AND TRADEMARK OFFICE

CERTIFICATE OF CORRECTION

PATENT NO. : 4,883,199

DATED : November 28, 1989

INVENTOR(S) : Quarve et al

It is certified that error appears in the above-identified patent and that said Letters Patent is hereby corrected as shown below:

On the title page:

Inventors: Vernon K. Quarve, Minneapolis
Dennis L. McCormick, Mendota Heights,
both of Minnesota Signed and Sealed this Twentieth Day of November, 1990

*Attest:*

HARRY F. MANBECK, JR.

*Attesting Officer*

*Commissioner of Patents and Trademarks*